US005928442A

United States Patent [19]

Machmeier et al.

[11] Patent Number: 5,928,442

[45] Date of Patent: Jul. 27, 1999

[54] MEDIUM/HIGH CARBON LOW ALLOY STEEL FOR WARM/COLD FORMING

[75] Inventors: Paul M. Machmeier, Racine; Anthony M. Matuszewski, Franklin; Stephen Marsch, Racine, all of Wis.; William Walsh, Lombard, Ill.

[73] Assignee: Snap-On Technologies, Inc., Lincolnshire, Ill.

[21] Appl. No.: 09/003,985

[22] Filed: Jan. 7, 1998

Related U.S. Application Data

[XX .

[60] Provisional application No. 60/056,737, Aug. 22, 1997, and provisional application No. 60/058,113, Sep. 5, 1997.

[51] Int. Cl.[6] ..... C22C 38/44; C22C 38/50; C21D 8/00

[52] U.S. Cl. ..... 148/335; 148/652; 420/106; 420/109

[58] Field of Search ..... 148/335, 651, 148/652, 653, 654; 420/106, 109

[56] References Cited

U.S. PATENT DOCUMENTS

| | | | |
|---|---|---|---|
| 901,739 | 10/1908 | Ragaller . | |
| 2,737,455 | 3/1956 | Kirkby et al. . | |
| 2,798,805 | 7/1957 | Hodge et al. . | |
| 2,861,908 | 11/1958 | Mickelson et al. . | |
| 3,093,519 | 6/1963 | Decker et al. . | |
| 3,364,013 | 1/1968 | Caton . | |
| 3,396,013 | 8/1968 | Mihalisin . | |
| 3,418,110 | 12/1968 | Godo et al. . | |
| 3,489,620 | 1/1970 | Current . | |
| 3,574,602 | 4/1971 | Gondon et al. . | |
| 3,595,707 | 7/1971 | Faunce et al. . | |
| 3,615,370 | 10/1971 | Ridal et al. . | |
| 3,891,474 | 6/1975 | Grange . | |
| 3,907,614 | 9/1975 | Bramfitt et al. . | |
| 3,992,303 | 11/1976 | Barker et al. . | |
| 3,995,465 | 12/1976 | Felton, Jr. . | |
| 4,011,106 | 3/1977 | Takechi et al. . | |
| 4,061,013 | 12/1977 | Kuc et al. . | |
| 4,076,525 | 2/1978 | Little et al. . | |
| 4,319,934 | 3/1982 | Henning . | |
| 4,322,247 | 3/1982 | Henning . | |
| 4,322,256 | 3/1982 | Henning . | |
| 4,326,886 | 4/1982 | Abeyama et al. . | |
| 4,466,842 | 8/1984 | Yada et al. . | |
| 4,517,029 | 5/1985 | Sonoda et al. . | |
| 4,714,502 | 12/1987 | Honkura et al. . | |
| 4,718,908 | 1/1988 | Wigginton et al. . | |
| 4,729,872 | 3/1988 | Kishida et al. . | |
| 4,741,786 | 5/1988 | Birman et al. . | |
| 4,765,849 | 8/1988 | Roberts | 420/109 |
| 4,823,451 | 4/1989 | Terrasse et al. . | |
| 4,842,823 | 6/1989 | Sawaragi et al. . | |
| 4,969,963 | 11/1990 | Honkura et al. . | |
| 4,975,242 | 12/1990 | Hoshino et al. . | |
| 5,021,215 | 6/1991 | Sawaragi et al. . | |
| 5,108,518 | 4/1992 | Fukui et al. . | |
| 5,156,691 | 10/1992 | Hollenberg et al. . | |
| 5,186,768 | 2/1993 | Nomoto et al. | 420/106 |
| 5,213,634 | 5/1993 | DeArdo et al. . | |
| 5,252,153 | 10/1993 | Ochi et al. . | |
| 5,310,032 | 5/1994 | Plichta . | |
| 5,427,600 | 6/1995 | Itoh et al. . | |
| 5,453,139 | 9/1995 | Gallagher, Jr. . | |
| 5,454,887 | 10/1995 | Fukui . | |
| 5,496,425 | 3/1996 | Gallagher, Jr. . | |
| 5,545,267 | 8/1996 | Ochi et al. | 148/335 |
| 5,558,726 | 9/1996 | Yatoh et al. . | |

FOREIGN PATENT DOCUMENTS

| | | |
|---|---|---|
| 0 078 254 A2 | 5/1983 | European Pat. Off. . |
| 63-065020 | 3/1988 | Japan . |
| 03047948 | 2/1991 | Japan . |
| 2 187 202 | 9/1987 | United Kingdom . |

*Primary Examiner*—Deborah Yee
*Attorney, Agent, or Firm*—Lee, Mann, Smith, McWilliams, Sweeney & Ohlson

[57] ABSTRACT

A medium/high carbon low alloy steel which can be cold formed by cold or warm forging and heat treated. The material consists essentially of:

| Element | Weight Percent |
|---|---|
| Carbon (C) | about 0.45–0.65 |
| Manganese (Mn) | about 0.35–0.45 |
| Chromium (Cr) | about 0.70–0.80 |
| Nickel (Ni) | about 0.35–0.50 |
| Molybdenum (Mo) | about 0.15–0.30 |
| Titanium (Ti) | about 0.01–0.02 |
| Aluminum (Al) | about 0.01–0.02 |
| Silicon (Si) | about 0.008–0.15 |
| Boron (B) | about 0.001–0.003 |
| Iron (Fe) | Balance |
| Vanadium (V) | Less than about 0.10 |
| Oxygen (O) | about 0.002–0.005 |
| Nitrogen (N) | about 0.001–0.008 |
| Copper (Cu) | Less than about 0.35 |
| Zirconium (Zr) | Less than about 0.01 |
| Antimony (Sb) | Less than about 0.01 |
| Tin (Sn) | Less than about 0.01 |
| Sulfur (S) | about 0.001–0.010 |
| Phosphorus (P) | about 0.001–0.02 |

The composition also defined by the following expressions based on weight percent:

$$\frac{\text{Carbon}}{\text{Manganese}}\left(\frac{C}{Mn}\right) = 1.0\text{–}1.81$$

-continued $$\frac{\text{Manganese}}{\text{Sulfer}}\left(\frac{Mn}{S}\right) = 35\text{–}350$$

$$\frac{(\text{Chromium} + \text{Nickel})}{\text{Molybdenum}}\left(\frac{Cr + Ni}{Mo}\right) = 3.5\text{–}8.7$$

$$\text{Boron}\left[\frac{(\text{Titanium} + \text{Aluminum})}{(\text{Nitrogen} + \text{Oxygen})^{\text{Phosphorus}}}\right] \times 10^3$$

$$\left(B\frac{(Ti + Al)}{(N + O)^P} \times 10^3\right) = 0.02\text{–}0.127$$

Moreover, it has been found that this material when quenched and then tempered at 400° F.±25° F. will exhibit surprising ductility, strength, toughness and hardness properties. The alloy disclosed herein is particularly useful in forming sockets for socket wrenches and needle-nosed pliers.

13 Claims, 2 Drawing Sheets

MEDIUM/HIGH CARBON LOW ALLOY STEEL FOR WARM/COLD FORMING

This application claims the benefit of (1) Provisional Application Ser. No. 60/056,737 filed Aug. 22, 1997 and (2) Provisional Application Ser. No. 60/058,113 filed Sep. 5, 1997.

BACKGROUND OF THE INVENTION

This invention relates to medium/high carbon low alloy steels which exhibit excellent cold/warm formability and subsequent heat treatment characteristics.

Articles such as hand tools and more particularly sockets for socket wrenches or needle-nosed pliers are usually fabricated of a steel, shaped by severe cold/warm forming (e.g. cold or warm forging at temperatures between about ambient and 1,600° F.) and then heat treated to achieve the desired final properties of hardness, strength, ductility and toughness. Ductility or strain-related characteristics of a material are related to both formability and toughness. Toughness is related to the ability of the material to absorb energy which can be related in turn to ductility and strength, reduction in area, impact toughness or fracture toughness.

Articles of the foregoing type may be manufactured in large quantities, need to exhibit a low fracture or failure rate in forming, should maintain dimensional tolerances and exhibit dimensional stability during forming and heat treatment, must provide the desired combination of final properties after heat treatment, must perform in the intended application and must exhibit high customer or user acceptance.

Hand tools such as needle-nosed pliers and wrench sockets are frequently used in automotive and industrial settings where impact loads and/or bending and/or wear are common occurrences. Plier tips which are slender and have gripping notches or teeth may fracture at the tip due to bending stresses particularly in the presence of notches or teeth. Moreover, sockets may be improperly used or overloaded and thus fracture, fail or wear prematurely. Furthermore, any new material should be capable of being formed and heat treated using present forming and thermal treating equipment and techniques.

Steels with a carbon content of less than about 0.30 weight percent are generally considered to be formable (after softening by the process known as spherodizing) by cold forming into various shapes. Some shapes have very small sections (e.g. thin wall and tips) into which the metal must flow and thus require particularly severe formation. Low carbon steels exhibit the required formability. However, some low carbon low alloy steels cannot be heat treated to exhibit acceptable properties in terms of hardness, strength, ductility and toughness.

But, other low carbon low alloy steels have been used in the manufacture of wrench sockets. See for example U.S. Pat. Nos. 4,319,934; 4,332,274; and 4,322,253. Parts made from the disclosed steels can be subsequently heat treated to between 48 and 50 Rockwell C ($R_c$) which suggests its wear and strength properties.

In the manufacture of needle-nosed pliers, medium/high carbon steels have been used to achieve the desired strength at the tip where substantial bending forces are incurred. But in the presence of notches (such as serrations or teeth) the present material does not exhibit sufficient toughness or the ability to absorb impacts. This material is hardened to achieve the higher strength for bending resistance or hardness for wire cutting edges that are provided. Thus, while the material must be hardenable, it must also be formable, tough and resist bending forces.

It is desirable to provide sockets, pliers and the like which exhibit greater wear, toughness and strength properties while still being formable by techniques and equipment developed and presently used. However, it is believed that the only way to achieve those greater properties is to provide a steel where the carbon content is increased to a level considered too high for acceptable part formation, without failure or fracture of the parts, without significant modification to existing part forming processes and equipment and without significant distortion.

It is generally known that high carbon steels can be heat treated to higher strength and hardness levels than low carbon steels but that high carbon steels are difficult to cold work or form especially in the same applications and by the same techniques as for the low carbon steels. Moreover, high carbon steels may not exhibit the desired ductility, toughness or formability.

There are some disclosures of steels that have a carbon content up to about 0.60 weight percent which are said to be useful in some cold forming processes of limited severity. See for example U.S. Pat. Nos. 3,489,620 and 4,326,886. However, materials so disclosed have not been found to have been used in the foregoing applications or for the foregoing types of parts. Reasons for nonuse may include the inability of the material to exhibit the required combination of properties (e.g. formability, strength, and toughness), availability, cost, etc.

Thus it is an object of this invention to provide a steel or family of related materials which can be used in socket-wrenches, needle-nosed pliers or similar parts which require severe cold/warm working, which material minimizes fracture of failure, which can be heat treated to enhanced properties such as hardness, toughness and strength and which material also minimizes part distortion.

This and other objects of this invention will become apparent from the following description and appended claims.

SUMMARY OF THE INVENTION

It has been found that a specific medium/high carbon low alloy steel with a carbon content of between about 0.45–0.65 weight percent can be cold formed into parts requiring severe cold forming or deformation (while using existing forming processes and equipment), exhibit a low failure or fracture rate, be heat treated to a high hardness to provide enhanced wear, strength, ductility and toughness properties, exhibit low dimensional distortion, be accepted in use and exhibit a low overall failure rate. Moreover and unexpectedly this material forms better than low carbon alloy steels and has better end use properties than formable high carbon steels.

The material of this invention's chemical composition is defined as:

| Element | Weight Percent |
|---|---|
| Carbon (C) | about 0.45–0.65 |
| Manganese (Mn) | about 0.35–0.45 |
| Chromium (Cr) | about 0.70–0.80 |
| Nickel (Ni) | about 0.35–0.50 |
| Molybdenum (Mo) | about 0.15–0.30 |
| Titanium (Ti) | about 0.01–0.02 |
| Aluminum (Al) | about 0.01–0.02 |
| Silicon (Si) | about 0.008–0.15 |
| Boron (B) | about 0.001–0.003 |
| Iron (Fe) | Balance |
| Vanadium (V) | Less than about 0.10 |
| Oxygen (O) | about 0.002–0.005 |
| Nitrogen (N) | about 0.001–0.008 |
| Copper (Cu) | Less than about 0.35 |
| Zirconium (Zr) | Less than about 0.01 |

-continued

| Element | Weight Percent |
|---|---|
| Antimony (Sb) | Less than about 0.01 |
| Tin (Sn) | Less than about 0.01 |
| Sulfur (S) | about 0.001–0.010 |
| Phosphorus (P) | about 0.001–0.02 |

The composition is also defined by the following expressions based on weight percent:

$$\frac{\text{Carbon}}{\text{Manganese}}\left(\frac{C}{Mn}\right) = 1.0\text{–}1.81$$

$$\frac{\text{Manganese}}{\text{Sulfer}}\left(\frac{Mn}{S}\right) = 35\text{–}350$$

$$\frac{(\text{Chromium} + \text{Nickel})}{\text{Molybdenum}}\left(\frac{Cr + Ni}{Mo}\right) = 3.5\text{–}8.7$$

$$\text{Boron}\left[\frac{(\text{Titanium} + \text{Aluminum})}{(\text{Nitrogen} + \text{Oxygen})^{\text{Phosphorus}}}\right] \times 10^3$$

$$\left(B\frac{(Ti + Al)}{(N + O)^P} \times 10^3\right) = 0.02\text{–}0.127$$

The foregoing material can be heat treated to a hardness up to about 64 Rockwell C ($R_c$).

In other words, the composition and ratios provide a material with the optimum combination of formability and heat treatment properties to permit formation of the desired products.

DESCRIPTION OF THE PREFERRED EMBODIMENT

Figure 1:
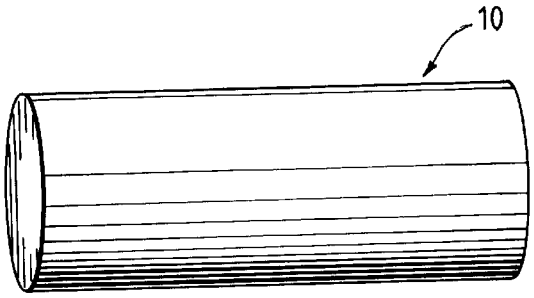
FIG. 1 is a side view of a metal cylinder or slug that is to be formed into a socket for a wrench.
Figure 2:
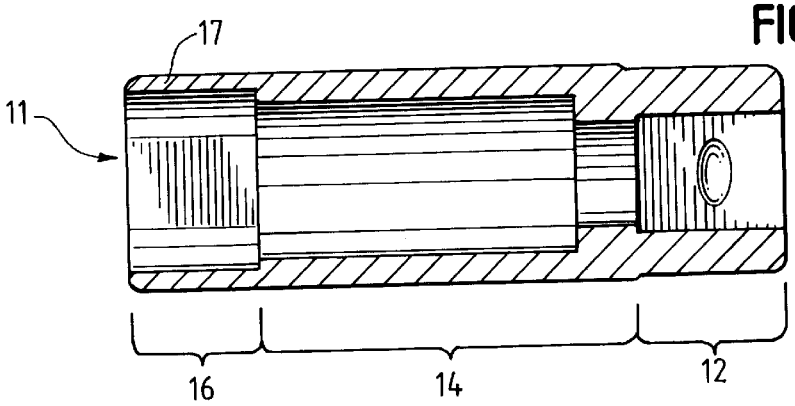
FIG. 2 is a sectional view of a socket formed from the slug of FIG. 1.

Referring to FIG. 1, a slug or cylindrical section 10 is cut from a wire of the selected material. The slug is used in a forming machine, which has several successive stations where the slug is formed (by successively extruding and piercing in the known manner) into a hollow and thin walled socket as shown in FIG. 2. The socket 11 includes a shank end 12 for receiving a wrench shank or driver, a spacer section 14 and a nut or bolt grasping end 16. Note the thin walled sections such as 17. The spacer section spaces the ends apart and can be used to accommodate nuts or bolts having an irregular length or shape, such as a spark plug. It will be appreciated that there has been substantial movement of metal in order to form the socket 11 from the slug 10. Moreover, it will be appreciated that the socket defines thin walls such as 17 particularly in the spacer 14 and nut grabbing 16 sections.

Figure 3:
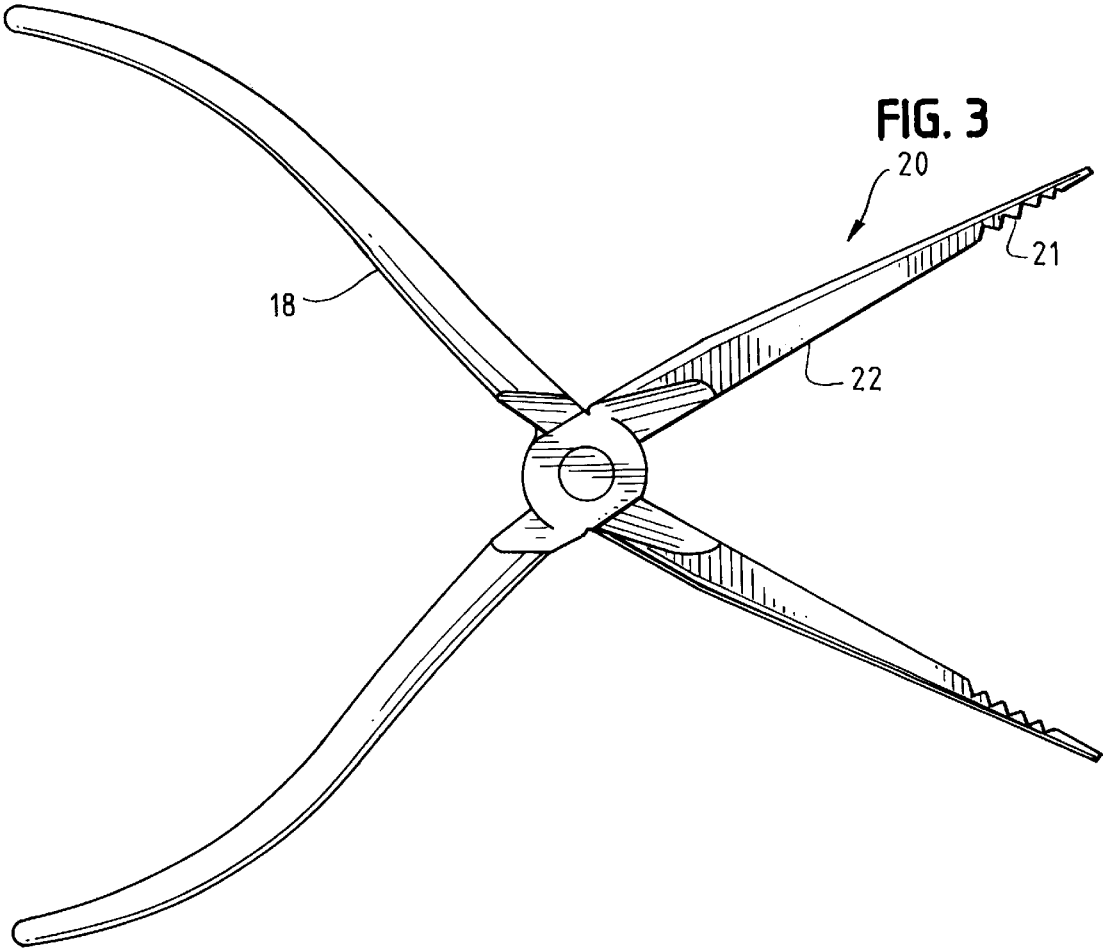
FIG. 3 is a plan view of a pair of needle-nose pliers.

Needle-nose pliers 18 are shown in FIG. 3, such pliers are forged and define a thin tapering tip such as 20. Serrations or notches 21 for gripping are formed into the tip; a hardened cutting blade or edge 22 for the cutting of wire is also provided.

It has been found that these parts can be successfully fabricated from materials having the following composition:

| Element | Weight Percent |
|---|---|
| Carbon (C) | about 0.45–0.65 |
| Manganese (Mn) | about 0.35–0.45 |
| Chromium (Cr) | about 0.70–0.80 |
| Nickel (Ni) | about 0.35–0.50 |
| Molybdenum (Mo) | about 0.15–0.30 |
| Titanium (Ti) | about 0.01–0.02 |
| Aluminum (Al) | about 0.01–0.02 |
| Silicon (Si) | about 0.008–0.15 |
| Boron (B) | about 0.001–0.003 |
| Iron (Fe) | Balance |
| Vanadium (V) | Less than about 0.10 |
| Oxygen (O) | about 0.002–0.005 |
| Nitrogen (N) | about 0.001–0.008 |
| Copper (Cu) | Less than about 0.35 |
| Zirconium (Zr) | Less than about 0.01 |
| Antimony (Sb) | Less than about 0.01 |
| Tin (Sn) | Less than about 0.01 |
| Sulfur (S) | about 0.001–0.010 |
| Phosphorus (P) | about 0.001–0.02 |

Also applicable are the following ratios based on weight percent:

$$\frac{\text{Carbon}}{\text{Manganese}}\left(\frac{C}{Mn}\right) = 1.0\text{–}1.81$$

$$\frac{\text{Manganese}}{\text{Sulfer}}\left(\frac{Mn}{S}\right) = 35\text{–}350$$

$$\frac{(\text{Chromium} + \text{Nickel})}{\text{Molybdenum}}\left(\frac{Cr + Ni}{Mo}\right) = 3.5\text{–}8.7$$

$$\text{Boron}\left[\frac{(\text{Titanium} + \text{Aluminum})}{(\text{Nitrogen} + \text{Oxygen})^{\text{Phosphorus}}}\right] \times 10^3$$

$$\left(B\frac{(Ti + Al)}{(N + O)^P} \times 10^3\right) = 0.02\text{–}0.127$$

The invention material's formability and final toughness properties appear to result in a significantly lower failure rate, principally related to the same mechanism involved in a reduction in the formation of grain boundary discontinuities and/or discontinuities at the carbide/ferrite interface after severe cold forming.

The material of this invention include two (2) more specific compositions referred to as Met 80 and Met 81 that are particularly useful in forming needle-nosed pliers and wrench sockets respectively.

The composition for these materials (expressed in weight percent) are as set forth above except as set forth below in Table I:

TABLE I

| Element | Met Spec 80 | Met Spec 81 |
|---|---|---|
| Carbon (C) | 0.56–.62 | 0.46–.52 |
| Nickel (Ni) | 0.40–.50 | 0.40–.50 |
| Molybdenum | 0.15–0.25 | 0.15–0.25 |
| Boron (B) | 0.0015–.0030 | 0.0015–.0030 |

In considering this invention, the material of the invention was compared to a number of available materials. The composition (expressed in weight percent) for the compared materials which are discussed herein are set forth in Table II.

TABLE II

| Element | M86B30 | 4140 | 4063 | 50B44 | 8660 | 5160 | 6150 | 4150 |
|---|---|---|---|---|---|---|---|---|
| C | 0.28–.33 | 0.38–0.43 | 0.60–0.67 | 0.43–0.48 | 0.55–0.65 | 0.55–0.65 | 0.48–0.53 | 0.48–0.53 |
| Mn | 0.50–0.70 | 0.75–1.00 | 0.75–1.00 | 0.75–1.00 | 0.75–1.00 | 0.75–1.00 | 0.75–0.90 | 0.75–1.00 |
| P | 0.025 | 0.040 | 0.040 | 0.040 | 0.040 | 0.040 | 0.040 | 0.040 |
| S | 0.025 | 0.040 | 0.040 | 0.040 | 0.040 | 0.040 | 0.040 | 0.040 |
| Si | 0.10 | 0.20–0.35 | 0.20–0.35 | 0.20–0.35 | 0.20–0.35 | 0.20–0.35 | 0.20–0.35 | 0.20–0.35 |
| Ni | 0.40–0.70 | — | — | — | 0.40–0.70 | — | — | — |
| Cr | 0.40–0.60 | 0.80–1.10 | — | 0.40–0.60 | 0.40–0.60 | 0.70–0.90 | 0.80–1.10 | 0.80–1.10 |
| Mo | 0.15–0.25 | 0.15–0.25 | 0.20–0.30 | — | 0.15–0.25 | — | 0.15 | 0.15–0.25 |
| B | 0.005–0.003 | — | — | 0.005–0.003 | — | — | — | — |

One comparison, which suggests failure rate, is to compare the frequency of discontinuities formed upon cold working. Table III sets forth the frequency of discontinuities upon severe cold working which can lead to failure, as observed in various materials used in the forming of wrench socket and at various depths along the inner diameter of the hexagonal head. The materials are M86B30, 4140 and Met 81 alloy steel. The object of this test was to determine the propensity of materials to form discontinuities during part deformation by cold working. All of these materials were spherodized, in the known manner, before forming. Based on carbon content the lower carbon materials (e.g. M86B30 and 4140) were expected to be the most formable and show the least discontinuities. However, Table III shows that Met 81 which has a carbon content of between 0.46–0.52 exhibits markedly fewer discontinuities than 0.30 and 0.40 carbon steels.

Specifically, M86B30 shows a high frequency (8–14 of discontinuities adjacent the surface (at 0–20 μm) which decreases toward the interior of the part. In Table III 4140 exhibits an improvement over M86B30 steel with there being about 0.5–4.5 discontinuities at 0–20 μm. But surprisingly Met 81 steel exhibits between 0 and 1.5 discontinuities at 0–20 μm. If Met 81 was a low carbon steel that result in and of itself would be surprising. But the result is particularly surprising since Met 81 is a medium carbon steel. In other words, Met 81 steel preformed in formability tests more favorably than was expected.

TABLE III

AVERAGE FREQUENCY OF DISCONTINUITIES WITH DEPTH AS MEASURED ALONG THE INSIDE DIAMETER OF THE HEX FOR A 13mm SIX POINT HEX SOCKET

| Depth From Base of Socket Hex | M86B30 DISTANCE FROM BOTTOM OF HEX, (Millimeters) | | | | | |
|---|---|---|---|---|---|---|
| (Microns or μm) | 1 | 2 | 3 | 5 | 7 | 9 |
| 0–20 | 9 | 8 | 14 | 11.5 | 13.2 | 16 |
| 20–40 | 6 | 5 | 5.5 | 8.5 | 11.5 | 7.5 |
| 40–60 | 3.5 | 3.5 | 2.5 | 4.8 | 8.5 | 6 |
| 60–80 | 2 | 3.5 | 4 | 3 | 6.5 | 5 |
| 80–100 | 1.5 | 1 | 3 | 2.5 | 2 | 2 |
| 100–120 | 1 | 1.5 | 2 | 1.5 | 1.5 | 2.5 |

| Depth From Base of Socket Hex | 4140 DISTANCE FROM BOTTOM OF HEX, (Millimeters) | | | | | |
|---|---|---|---|---|---|---|
| (Microns or μm) | 1 | 2 | 3 | 5 | 7 | 9 |
| 0–20 | 0.5 | 2.7 | 2.5 | 4.5 | 4 | 1.8 |
| 20–40 | 2 | 0.5 | 0.5 | 1.5 | 2.5 | 3 |
| 40–60 | 1.5 | 0 | 0 | 0.5 | 0.5 | 1 |
| 60–80 | 1 | 1.5 | 0.5 | 0.5 | 0.5 | 1 |
| 80–100 | 0 | 0.5 | 0 | 1 | 0.5 | 1 |
| 100–120 | 0 | 0.5 | 0 | 0.5 | 0 | 1 |

| Depth From Base of Socket Hex | MET 81 DISTANCE FROM BOTTOM OF HEX, (Millimeters) | | | | | |
|---|---|---|---|---|---|---|
| (Microns or μm) | 1 | 2 | 3 | 5 | 7 | 9 |
| 0–20 | 0 | 0 | 0.5 | 0.5 | 1.5 | 1 |
| 20–40 | 1 | 0.5 | 1 | 0 | 0 | 0 |
| 40–60 | 0 | 0 | 0.5 | 0 | 0 | 0.5 |
| 60–80 | 0.5 | 0.5 | 0 | 0.5 | 0 | 0 |
| 80–100 | 0 | 0 | 0 | 0 | 0 | 0 |
| 100–120 | 0 | 0 | 0 | 0.5 | 0 | 0 |

In another series of comparison tests, the metal flow characteristics were studied at various temperatures and rates of deformation by means of a torsion test. The torsion test provides the ability to achieve high strains with uniform deformation. The metal flow is studied to determine the behavior under large permanent (plastic) strains to understand metalworking parameters including press loads and die fill. Cold or warm forging press loads are related to the change in flow stress with increasing temperature and strain rates. Die fill is partly limited by the flow stress and by the amount of deformation a metal will undergo up to the point where no cracking will occur.

Generally for metals at cold working temperatures, the flow stress will increase with increasing strain through a process of work hardening until final fracture. At warm working temperatures, a peak flow stress occurs at a strain of 0.5 to 1.5 after which the flow stress decreases to a steady state value until failure. In the table of "Deformation Effective Flow Stress" (Table IV), the effective flow stresses at a strain of 0.1 are shown at temperatures of 900° F. or below while the peak flow stresses are recorded above that temperature. Especially at the lower temperature range, it was expected that the lower carbon alloy steels would have substantially reduced flow stresses. However, the Met 80 and Met 81 steels were unexpectedly comparable to a 0.44% carbon steel (50B44). Above 900° F., all the steels showed a strain rate sensitivity where the flow stress increased with strain rate. However, for a constant strain rate, the flow stresses were about the same.

TABLE IV

DEFORMATION EFFECTIVE FLOW STRESSES

| ALLOY | NOMINAL PERCENT CARBON | STRAIN RATE SEC(−1) | DEFORMATION TEMPERATURE (DEGREES FAHRENHEIT) FLOW STRESS AT A STRAIN OF 1.0 70° F. | 300° F. | 600° F. | 900° F. | PEAK FLOW STRESS (KSI) 1200° F. | 1300° F. | 1400° F. | 1500° F. | 1600° F. |
|---|---|---|---|---|---|---|---|---|---|---|---|
| M86B30 | 0.30 | 1.0 | 107.9 | 91.2 | 90.6 | 70.6 | 39.2 | — | 32.1 | — | 20.6 |
| M86B30 | 0.30 | 10.0 | 106.6 | 89.3 | 85.4 | 75.8 | 44.3 | — | 37.9 | — | 28.3 |
| 50B44 | 0.44 | 1.0 | 118.0 | 101.0 | 97.6 | 73.8 | 37.9 | — | 30.8 | — | 19.3 |
| 50B44 | 0.44 | 10.0 | 116.2 | 102.0 | 90.6 | 79.6 | 46.2 | — | 39.8 | — | 28.3 |
| 6150 | 0.50 | 0.2 | — | — | — | — | 26.7 | 27.9 | 26.5 | 21.9 | — |
| 6150 | 0.50 | 5.0 | — | — | — | — | 41.0 | 41.5 | 40.5 | 35.2 | — |
| MET 81 | 0.50 | 1.0 | 118.2 | 100.2 | 95.7 | 75.8 | 39.8 | — | 35.3 | — | 21.2 |
| MET 81 | 0.50 | 10.0 | 115.6 | 100.8 | 91.2 | 82.2 | 49.4 | — | 41.7 | — | 28.9 |
| 5160 | 0.60 | 1.42 | — | — | — | — | 46.8 | 35.6 | 37.8 | 31.6 | 25.1 |
| 4063 | 0.60 | 1.42 | — | — | — | — | 48.4 | 36.1 | 39.5 | 30.9 | 24.6 |
| MET 80 | 0.60 | 1.0 | 120.1 | 102.1 | 99.5 | 75.1 | 39.2 | — | 34.7 | — | 20.6 |
| MET 80 | 0.60 | 10.0 | 120.1 | 100.8 | 91.8 | 82.8 | 48.2 | — | 39.8 | — | 27.6 |

In bulk deformation processing of spherodized steel, failure usually occurs by ductile mechanisms. Process restraints to metal deformation are excessive press loads and restrictive metal flow due to early flow localization. In spherodized engineering carbon steel alloys, second phase particles are made up of $Fe_3C$ carbides and nonmetallic inclusions.

In very large plastic strain fields, cavities will predominantly form on particle interfaces by tearing the carbide inclusions away from the ductile matrix or by cracking of non-deformable particles. Damage in the form of particle fracture or decohesion can result in void nucleation, void growth and strain localization in the matrix. The competition between these events and their rate of progression will depend on the flow stress and work la hardening behavior of the matrix, particle bonding, and overall macroscopic stress state. Generally, it's a case where strain hardening is being offset by strain localization.

Referring to the table of "Maximum Deformation Effective Strain With Temperature" (Table V), it was unexpected that the maximum effective strain of the Met 81 (0.5% carbon) and the Met 80 (0.6% carbon) steel was comparable to the 5OB44 (0.44% carbon) steel at ambient temperature (cold working temperature) and only marginally less than M86B30 (0.30% carbon) steel. In the warm forming range (900 to 1600° F.) the Met 80 and Met 81 steels display progressively improving forming strain when compared to other steel with carbon contents of 0.30–0.60% carbon. Evidently, this improved behavior is resultant from a combination of reduced work hardening rate concomitant with a matrix insensitivity to shear localization where the carbide/matrix interface demonstrates improved bond strength.

The strain measurement is dimensionless as (in/in), etc. and is directly related to proper die fill and metal flow during the forging process. In addition, high values of strain indicate a reduced incidence of internal bursts and surface cracking during severe deformation.

TABLE V

MAXIMUM DEFORMATION EFFECTIVE STRAIN WITH TEMPERATURE

| ALLOY | STRAIN RATE SEC(−1) | DEFORMATION TEMPERATURE (DEGREES FAHRENHEIT) 70° F. | 300° F. | 600° F. | 900° F. | 1200° F. | 1300° F. | 1400° F. | 1500° F. | 1600° F. |
|---|---|---|---|---|---|---|---|---|---|---|
| M86B30 | 1.0 | 2.80 | 3.03 | 2.37 | 5.08 | 10.39 | — | 16.74 | — | 164.54 |
| M86B30 | 10.0 | 3.40 | 3.40 | 3.03 | 3.45 | 10.20 | — | 187.00 | — | 115.40 |
| 50B44 | 1.0 | 2.20 | 2.20 | 1.56 | 5.08 | 9.81 | — | 185.00 | — | 77.90 |
| 50B44 | 10.0 | 2.20 | 2.47 | 2.59 | 2.83 | 10.39 | — | 138.99 | — | 58.89 |
| 6150 | 0.2 | — | — | — | — | 3.30 | 2.00 | 7.42 | 6.01 | — |
| 6150 | 5.0 | — | — | — | — | 7.99 | 8.54 | 9.86 | 11.41 | — |
| MET 81 | 1.0 | 2.29 | 2.14 | 1.73 | 4.58 | 10.74 | — | 53.69 | — | 241.04 |
| MET 81 | 10.0 | 2.28 | 2.54 | 2.29 | 3.10 | 15.07 | — | 439.36 | — | 134.52 |
| 5160 | — | — | — | — | — | 3.40 | 5.60 | 6.90 | 18.50 | 18.10 |
| 4063 | — | — | — | — | — | 3.10 | 5.80 | 19.30 | 22.00 | 21.90 |
| MET 80 | 1.0 | 2.14 | 2.10 | 1.73 | 5.08 | 10.97 | — | 56.00 | — | 238.45 |
| MET 80 | 10.0 | 2.40 | 2.52 | 2.27 | 3.18 | 19.40 | — | 338.90 | — | 228.05 |

Note: $\epsilon$ or Effective Strain denotes a demensionless measurement (in/in.).

During formation, particularly of socket-wrenches, it was found that the Met 81 steel performed in substantially the same manner as 4140 and M86B30. Thus the substantially same equipment, forces and other processes could be used. In other words the material of this invention could be substituted in the forming process, without significant modifications thereto. The same is true for pliers.

Moreover, parts so formed exhibited little, if any, dimensional distortion during formation. Interestingly, parts made of the Met 81 material exhibited a smaller standard deviation from the mean than other materials, suggesting more accurate formation. Put another way, the range from +3σ (sigma) to −3σ (sigma) from the average value was smaller for the materials of this invention than for parts of other materials.

Another set of important factors is the heat treatability of the material after forming. The heat treatment usually includes oil quenching from an elevated temperature (e.g. 1550° F.) and then tempering.

Figure 6:
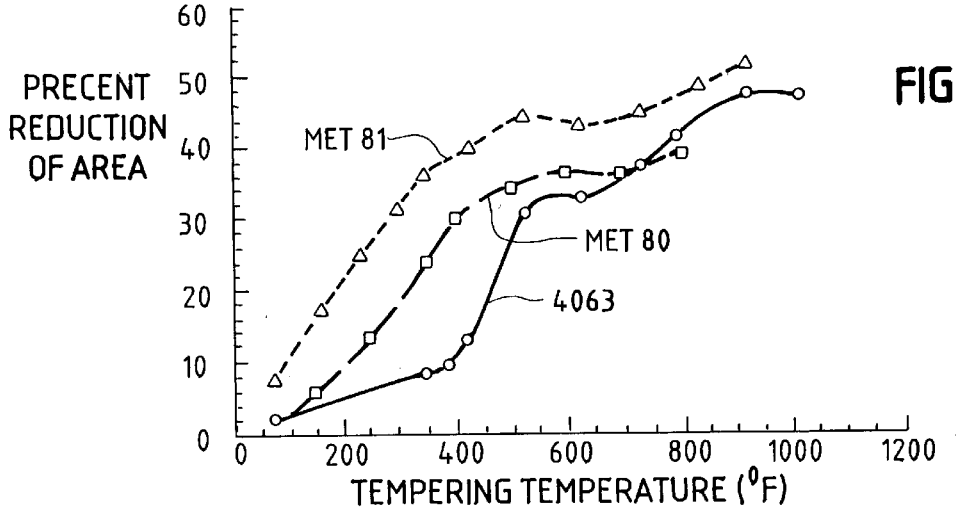

Referring first to FIG. 6, reduction of area (a measure of ductility) is plotted against tempering temperature for 4063, Met 80 and Met 81 alloy steel. It is seen that 4063 alloy steel exhibits a significant change in ductility at about 400° F. Moreover, the largest differences in ductility between 4063 & Met 80 and 4063 & Met 81 alloy steels are at about 400° F.±25°. While it would be expected that 4063 steel exhibit low ductility it was also expected that Met 80 and Met 81 steel would exhibit a similar low ductility. The fact that Met 80 and Met 81 steels were significantly more ductile at a tempering temperature of 400° F.±25° F. was surprising and the differences when compared to 4063 steel were very surprising.

Figure 5:
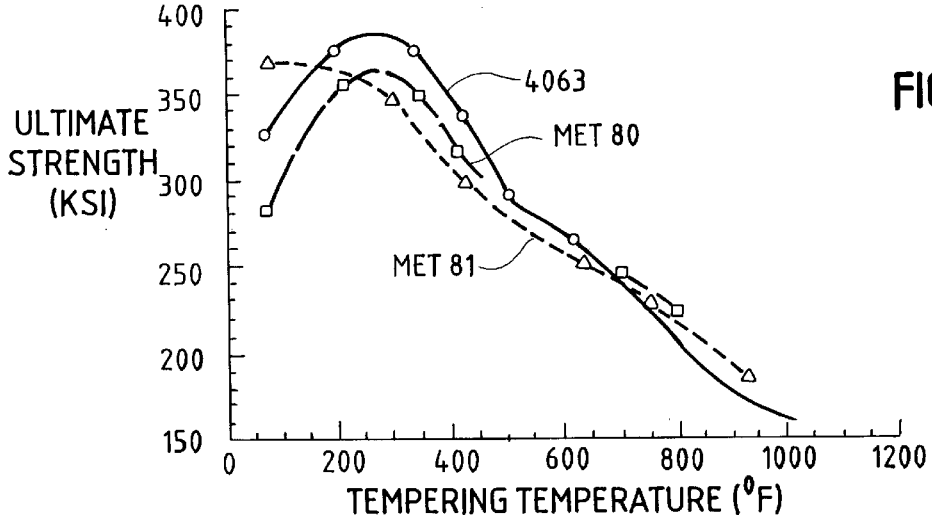

Referring now to FIG. 5, the Ultimate Tensile Strength (UTS) of the materials is compared. At the 400° F. tempering temperature of Met 80 and Met 81 is on the order of 320 Ksi (thousand pounds per square inch). The UTS of 4063 alloy steel is about 355 Ksi. Thus not withstanding the greater ductility the UTS of the inventive material is high and the UTS is about 90% of 4063 alloy steel. The balance of strength and toughness of the steels of this invention at these tempering temperatures are conducive to the tool applications.

Figure 4:
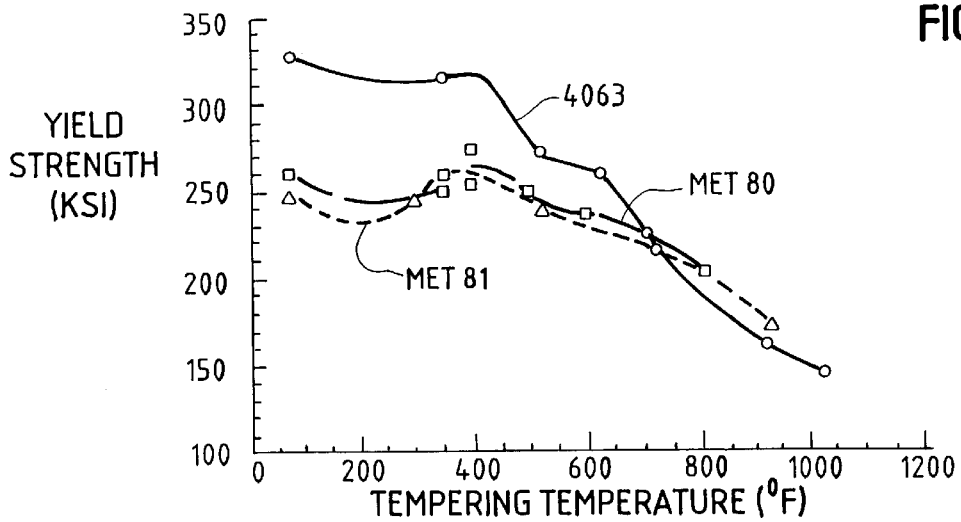
FIGS. 4, 5 and 6 depict the yield, tensile strength and percent reduction in an area as related to tempering temperature for various materials.

Referring to FIG. 4, the yield strength of these materials are plotted versus tempering temperature. Here the yield strength of Met 80 and Met 81 is about 265 Ksi at tempering temperature of about 400° F. The 4063 steel yield strength is about 320 Ksi.

From FIGS. 4, 5 and 6 it can be concluded that the materials of this invention exhibit a surprising level of ductility at a tempering temperature of about 400° F., especially when compared to 4063 alloy steel. Moreover, at that tempering temperature the material's ultimate tensile strength is high and very similar to 4063 alloy steel. The yield strength while somewhat lower is sufficiently similar, especially in light of the other properties.

Another series of comparison tests were run to determine stress and strain impact characteristics. Materials such as 4063, 8660, 5160, 6150 and 4150 alloy steels were compared to Met 80 steel. For a given ultimate tensile strength level the material of this invention exhibited superior fracture toughness, impact strength and ductility as compared to the other high carbon alloy steels.

More specifically, when the Met 80 steel is compared with 8660, 5160 and 4063 alloy steels, Met 80 exhibits surprisingly greater tensile strain values at the same stress level. Viewed in another way for the same strain the invention material strength properties should be greater.

Furthermore, in heat treatment parts made of the materials of this invention exhibit low and acceptable distortion which is improved relative to that for the low carbon steels.

Based on the foregoing it can be concluded that the medium/high carbon low alloy steel disclosed herein can be cold formed into products in a manner similar to low carbon steels and exhibit a lower propensity to fail. Thus current techniques and equipment can be used. Thus it is particularly surprising when compared to similar materials. It is theorized that this may be due to grain boundary and carbide interface composition control and related improved particle/matrix and grain boundary cohesion to the ratios herein.

Moreover the material herein can be heat treated by oil quenching and tempering to 400° F.±25° F. and provide superior ductility or strain with high strength and impact properties.

Thus by this invention a unique material is provided. Moreover the material exhibits particularly unexpected properties as compared to materials believed to be most similar.

It has been found that the Met 80 material is particularly useful in forming needle-nosed pliers as it provides strength at the pliers' tip where it bends the most as when gripping and rotating a nut or bolt. The pliers can also be hardened for the wire cutter section. Moreover this material exhibits greater toughness in the presence of notches, particularly bending loads. In particular, it has been found that formed and heat treated Met 80 material exhibits greater resistance to tip breakage at generally lower hardness levels than 4063 material.

As indicated hereinbefore Met 81 is particularly useful in socket formation. Thus from the foregoing it is seen that the material of this invention provides enhanced properties for the respective parts without significant changes in the forming or treatment processes.

Numerous changes and modifications can be made to the material and processes disclosed herein without departing from the spirit and scope of this invention.

What is claimed is:

1. A medium/high carbon low alloy steel for cold/warm forming and heat treatment which consists essentially of, on a weight percent basis:

| Element | Weight Percent |
|---|---|
| Carbon (C) | about 0.45–0.65 |
| Manganese (Mn) | about 0.35–0.45 |
| Chromium (Cr) | about 0.70–0.80 |
| Nickel (Ni) | about 0.35–0.50 |
| Molybdenum (Mo) | about 0.15–0.30 |
| Titanium (Ti) | about 0.01–0.02 |
| Aluminum (Al) | about 0.01–0.02 |
| Silicon (Si) | about 0.008–0.15 |
| Boron (B) | about 0.001–0.003 |
| Iron (Fe) | Balance |
| Vanadium (V) | Less than about 0.10 |
| Oxygen (O) | about 0.002–0.005 |
| Nitrogen (N) | about 0.001–0.008 |
| Copper (Cu) | Less than about 0.35 |
| Zirconium (Zr) | Less than about 0.01 |
| Antimony (Sb) | Less than about 0.01 |
| Tin (Sn) | Less than about 0.01 |
| Sulfur (S) | about 0.001–0.010 |
| Phosphorus (P) | about 0.001–0.02 |

and the alloy steel is also defined by the following expressions based on weight percent:

$$\frac{\text{Carbon}}{\text{Manganese}} = 1.0\text{–}1.81$$

$$\frac{\text{Manganese}}{\text{Sulfer}} = 35\text{–}350$$

$$\frac{(\text{Chromium} + \text{Nickel})}{\text{Molybdenum}} = 3.5\text{–}8.7$$

-continued $$\text{Boron}\left[\frac{(\text{Titanium}+\text{Aluminum})}{(\text{Nitrogen}+\text{Oxygen})^{\text{Phosphorus}}}\right]\times 10^3 = 0.02\text{–}0.127$$

which alloy is formable under severe cold working and subsequently heat treatable to provide selected final properties.

2. An alloy steel as in claim 1 wherein the alloy is heat treatable up to a hardness of 64 Rockwell ($R_c$).

3. An alloy steel as in claim 1 wherein:

| Element | Weight Percent |
|---|---|
| Carbon (C) | about 0.56–0.62 |
| Nickel (Ni) | about 0.40–0.50 |
| Molybdenum (Mo) | about 0.15–0.25 |
| Boron (B) | about 0.0015–0.0030. |

4. An alloy steel as in claim 1 wherein:

| Element | Weight Percent |
|---|---|
| Carbon (C) | about 0.46–0.52 |
| Nickel (Ni) | about 0.40–0.50 |
| Molybdenum (Mo) | about 0.15–0.25 |
| Boron (B) | about 0.0015–0.0030. |

5. An alloy steel as in claim 4 wherein said composition and ratios provide said alloy steel with an optimum combination of formability and heat treatment properties to permit the formation of wrench sockets.

6. An alloy steel as in claim 3 wherein said composition and ratios provide said alloy steel with an optimum combination of formability and heat treatment properties to permit the formation of needle-nose pliers.

7. A method of producing a cold/warm formed and heat treated article comprising the steps of:

providing a medium/high carbon low alloy steel consisting essentially of:

| Element | Weight Percent |
|---|---|
| Carbon (C) | about 0.45–0.65 |
| Manganese (Mn) | about 0.35–0.45 |
| Chromium (Cr) | about 0.70–0.80 |
| Nickel (Ni) | about 0.35–0.50 |
| Molybdenum (Mo) | about 0.15–0.30 |
| Titanium (Ti) | about 0.01–0.02 |
| Aluminum (Al) | about 0.01–0.02 |
| Silicon (Si) | about 0.008–0.15 |
| Boron (B) | about 0.001–0.003 |
| Iron (Fe) | Balance |
| Vanadium (V) | Less than about 0.10 |
| Oxygen (O) | about 0.002–0.005 |
| Nitrogen (N) | about 0.001–0.008 |
| Copper (Cu) | Less than about 0.35 |
| Zirconium (Zr) | Less than about 0.01 |
| Antimony (Sb) | Less than about 0.01 |
| Tin (Sn) | Less than about 0.01 |

-continued

| Element | Weight Percent |
|---|---|
| Sulfur (S) | about 0.001–0.010 |
| Phosphorus (P) | about 0.001–0.02 |

and composition also defined by the following expressions based on weight percent:

$$\frac{\text{Carbon}}{\text{Manganese}} = 1.0\text{–}1.81$$

$$\frac{\text{Manganese}}{\text{Sulfer}} = 35\text{–}350$$

$$\frac{(\text{Chromium}+\text{Nickel})}{\text{Molybdenum}} = 3.5\text{–}8.7$$

$$\text{Boron}\left[\frac{(\text{Titanium}+\text{Aluminum})}{(\text{Nitrogen}+\text{Oxygen})^{\text{Phosphorus}}}\right]\times 10^3 = 0.02\text{–}0.127$$

spheroidizing said alloy steel, shaping said article by forming said alloy steel at temperatures between about 68° F. and about 1,600° F.; and heat treating said formed article by quenching from an elevated temperature and then tempering at about 400° F.±25° F. to provide selected final properties.

8. A method as in claim 7 wherein said alloy steel consists essentially of:

| Element | Weight Percent |
|---|---|
| Carbon (C) | about 0.56–0.62 |
| Nickel (Ni) | about 0.40–0.50 |
| Molybdenum (Mo) | about 0. 15–0.25 |
| Boron (B) | about 0.0015–0.0030. |

9. A method as in claim 7 wherein said alloy steel consists essentially of:

| Element | Weight Percent |
|---|---|
| Carbon (C) | about 0.46–0.52 |
| Nickel (Ni) | about 0.40–0.50 |
| Molybdenum (Mo) | about 0.15–0.25 |
| Boron (B) | about 0.0015–0.0030. |

10. A method as in claim 8 wherein said forming consists of cold working by forging.

11. A method as in claim 10 wherein said article is a needle-nosed pliers.

12. A method as in claim 9 wherein said forming consists of cold working which is a combination of extruding and piercing and said article is a socket for a socket wrench.

13. A method as in claim 7 wherein said article is heat treated to a hardness up to 64 $R_c$.

* * * * *